US005879171A

United States Patent [19]

Wu

[11] Patent Number: 5,879,171

[45] Date of Patent: Mar. 9, 1999

[54] HIGH DENSITY ELECTRICAL CONNECTOR

[75] Inventor: Kun-Tsan Wu, Taipei-Hsien, Taiwan

[73] Assignee: Hon Hai Precision Ind. Co., Ltd., Taipei Hsien, Taiwan

[21] Appl. No.: 939,380

[22] Filed: Sep. 29, 1997

[30] Foreign Application Priority Data

Nov. 18, 1996 [TW] Taiwan ..... 85217752

[51] Int. Cl.[6] ..... H01R 9/09

[52] U.S. Cl. ..... 439/79; 439/892

[58] Field of Search ..... 439/79, 80, 892.1, 439/352

[56] References Cited

U.S. PATENT DOCUMENTS 5,591,036 1/1997 Doi et al. ..... 439/79

5,643,010 7/1997 Wu ..... 439/79

5,679,009 10/1997 Okumura et al. ..... 439/79

5,709,556 1/1998 Tan et al. ..... 439/79

*Primary Examiner*—Steven L. Stephan

*Assistant Examiner*—T C Patel

[57] ABSTRACT

A high density electrical connector for electrically connecting an exterior mating connector and a circuit board, mainly comprises an insulative housing, a shell, a plurality of contacts and a spacer. The insulative housing receives the contacts therein and has a pair of two-stage locking means which each includes a first stage and a second stage. The spacer forms a pair of latching portions and defines a plurality of cavities therein. By means of gradual cooperation between the two-stage locking means and the latching portions, the contacts are gradually oriented and guided in two stages by the cavities of the spacer to be precisely inserted into a plurality of apertures formed on the circuit board without resulting in a buckling of the contacts.

7 Claims, 3 Drawing Sheets

HIGH DENSITY ELECTRICAL CONNECTOR

BACKGROUND OF THE INVENTION

1. Field of the Invention

The present invention relates to a high density electrical connector for electrically connecting an exterior mating connector to a circuit board, and particularly to an electrical connector with a plurality of high density contacts which is quickly and precisely inserted into a plurality of apertures defined on a circuit board by means of gradual guidance.

2. The Prior Art

To increase the transmission speed of input/output messages between electrical connectors in electrical apparatus like computer systems, high density electrical connectors, which have a plurality of contacts in a high density arrangement, are proposed. However, the high density arrangement of the contacts results in a very small pitch between adjacent contacts. Therefore, such high density electrical connectors are usually equipped with a spacer to orient the contacts thereby preventing them from coming too close to each other and assuring that the contacts are precisely inserted into the associated apertures formed on a circuit board. To further assure that the contacts are correctly inserted as mentioned above, guiding posts are often utilized with the connector to retentively cooperate with the orienting holes formed on the circuit board.

Although some conventional high density electrical connectors as disclosed in Taiwan Patent Application Nos. 83,217,760, 83,216,747 and 83,217,761, are assembled with a space to orient a plurality of contacts thereof, one portion of each contact extending through the space is long enough to cause difficulty to exactly insert the contacts into the corresponding apertures of the circuit board, which may result in the buckling of the contacts.

Accordingly, to resolve the above disadvantages, an object of the present invention is to provide a high density electrical connector with a pair of two-stage locking means to cooperate with a spacer to gradually orient and guide a plurality of contacts to be precisely inserted into the corresponding apertures defined on a circuit board. The two-stage means includes a first stage for allowing a tail portion of each contact to extend through the space in a tip area thereof to be oriented and correctly aligned with the apertures of the circuit board, and a second stage for allowing the tail portion to be further inserted through the spacer in a longer length thereof.

SUMMARY OF THE INVENTION

According to an embodiment of the present invention, a high density electrical connector for precisely mounting on a circuit board mainly comprises a shell, an insulative housing, a plurality of contacts, and a spacer. The insulative housing defines a plurality of passageways for receiving the contacts therein, and forms a pair of two-stage locking means including a first stage and a second stage wherein a groove is located above each stage which is defined by a guiding surface and an engaging surface. The spacer forms a pair of latching portions and defines a plurality of cavities therein. By means of retentive and gradual cooperation between the two-stage locking means and the latching portions, the contacts can be oriented and guided in stages by the cavities of the spacer to be precisely inserted into a plurality of apertures defined on the circuit board without resulting in a buckling of the contacts.

DETAILED DESCRIPTION OF THE PREFERRED EMBODIMENTS

Figure 1:
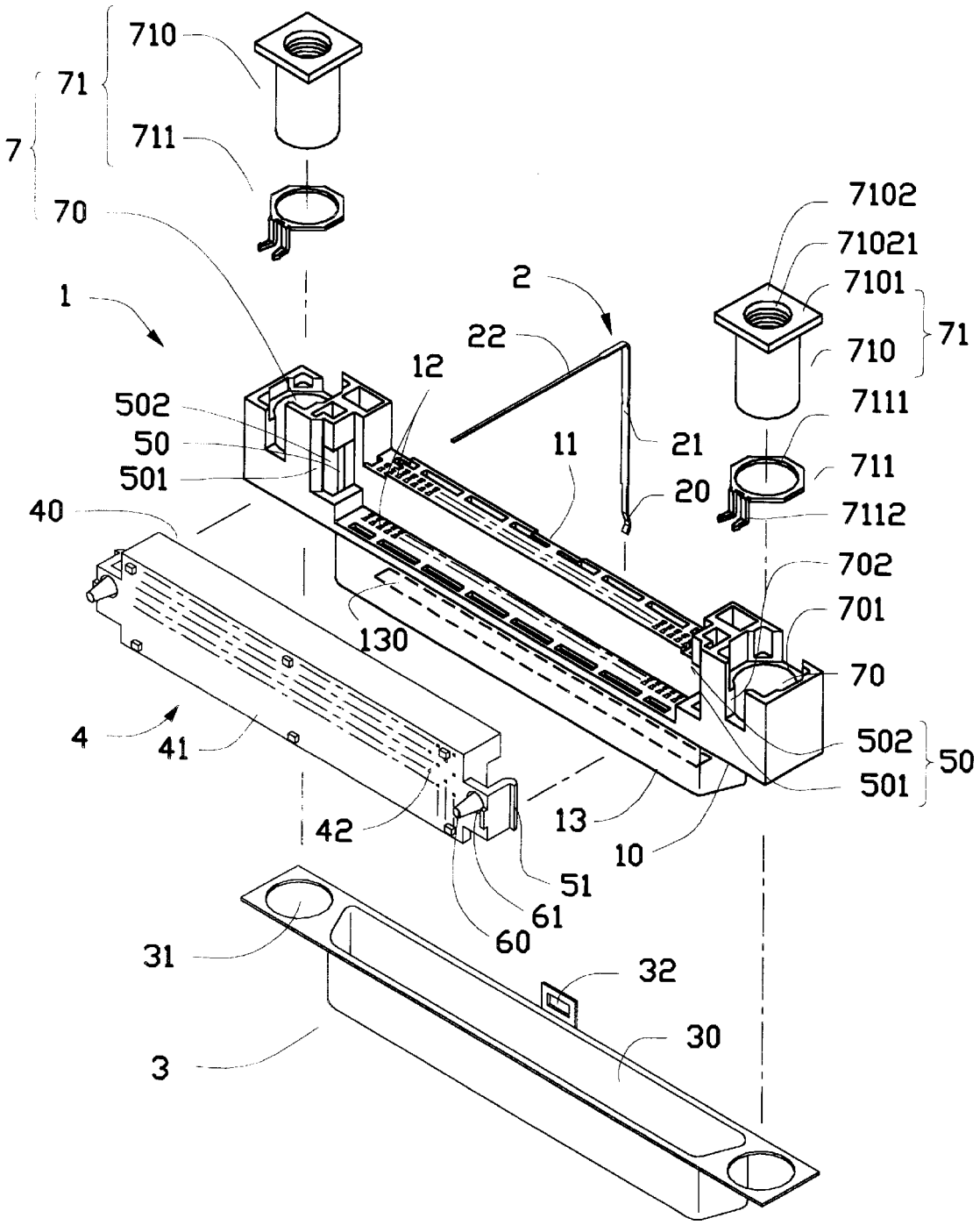
FIG. 1 is an exploded view of a high density electrical connector according to the present invention.

References will be made in detail to the preferred embodiments of the invention. As shown in FIG. 1, a high density electrical connector for electrically connecting an exterior mating connector (not shown) and a circuit board (not shown) includes an insulative housing (1), a plurality of contacts (2), a shell (3) and a spacer (4).

Furthermore, as shown in FIGS. 1, 3(A) & 3(B), the insualtive housing (1) includes a first surface (10) and a second surface (11) having two rows of passageways (12) defined therethrough, for receiving the contacts (2) therein. The first surface (10) integrally forms a mating portion (13) thereon which defines a mating slot (130) communicating with said passageways (12) for receiving the exterior mating connector.

The shell (3) formed by stamping a metal sheet, defines a hollow portion (30) and a pair of holes (31) for shielding the first surface (10) and the mating portion (13) of the housing (1). The contacts (2) received within said passageways (12), each includes a contact portion (20), an interfering portion (21) and a tail portion (22) wherein the tail portion (22) is extended outward from said second surface (11) as shown in FIG. 3(A)

Figure 2:
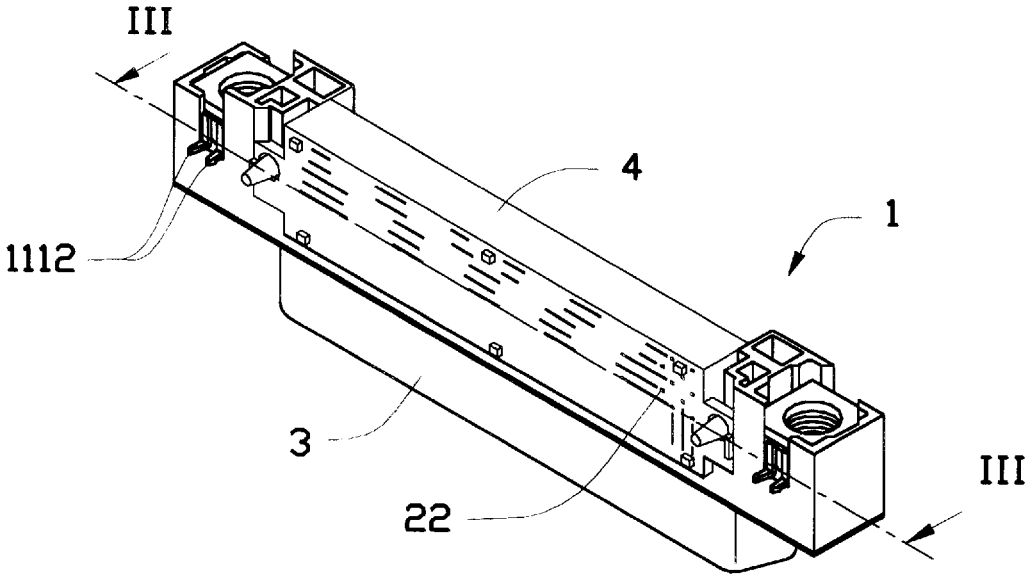
FIG. 2 is a perspective view of the assembled high density electrical connector of FIG. 1.

A pair of board retaining means (7) are respectively located at two opposite lateral ends of the housing (1) and each consists of a receiving portion (70) and a retentive portion (71). The receiving portion (70) longitudinally extends through both first surface (10) and second surface (11) at each lateral end of the housing (1) and defines a pit (701) and a notch (702) adjacent to said second surface (11) for receiving the retentive portion (71) therein. The retentive portion (71) consists of a sleeve (710) and a board Lock (711) wherein the board lock (711) defines a through hole (riot labeled) for receiving said sleeve (710) which defines a screw hole (71021) therein. In assembly, when the sleeve (710) of the retentive portion (71) is received within the receiving portion (70), a lip (7101) of the sleeve (710) and a ring (7111) of the board lock (711) are both received within the pit (701) of the receiving portion (70), and a pair of spaced claws (7112) of the board lock (711) vertically extend outward through the notch (702) of the receiving portion (70) to interlock with a corresponding hole (not shown) on the circuit board (8) as shown in FIG. 2.

As shown in FIGS. 1, 3(A) & 3(B), a two-stage locking means (not labeled) is integrally formed on an inner wall of each receiving portion (70) adjacent to the two rows of passageways (12) on the second surface (11). The locking means consists of a first stage (52) and a second stage (53) located at different levels wherein each stage (52, 53) is configured by an oblique guiding surface (501) on one side and a horizontal engaging surface (502) on the other. A groove (50) is further located above the engaging surface (502) of each stage (52, 53). Therefore, the first stage (52) and the second stage (53) of each locking means lie in a tooth-like arrangement.

The spacer (4) is bound by a top surface (40) and a bottom surface (41) and defines a plurality of orienting cavities (42) from said top surface (40) to said bottom surface (41) for receiving the tail portions (22) of the contacts (2). A pair of spring latching portions (51) respectively and vertically extend from opposite ends of the bottom surface (41) of the spacer (4) to retentively cooperate with said locking means (not labeled) of the housing (1). A pair of posts (60) are formed on the bottom surface (41) of the spacer (4) to be retained within a pair of corresponding orienting holes (80) defined in the circuit board (8) as shown in FIG. 3(A).

FIGS. 3(A) & 3(B) illustrate the mounting of the connector to the circuit board (8). Referring firstly to FIG. 3(A), by means of a first manual operation, each latching portion (51) of the space (4) is compressed inwardly by the guiding surface (501) of each first stage (52) to elastically enter the groove (50) located above the first stage (52) and to retentively engage with the engaging surface (502) of the first stage (52) whereby the spacer (4) can be temporary retained in the housing (1). Concurrently, the tail portions (22) of the contacts (2) are inserted through the cavities of the spacer (4) in a tip area thereof for initial orientation. Therefore, by inserting the posts (60) of the spacer (4) into the corresponding orienting holes (80) of the circuit board (8), the tips of the tail portions (22) of the contacts (2) are easily and precisely aligned with the apertures (not labeled) on the circuit board (8).

Figure 3:
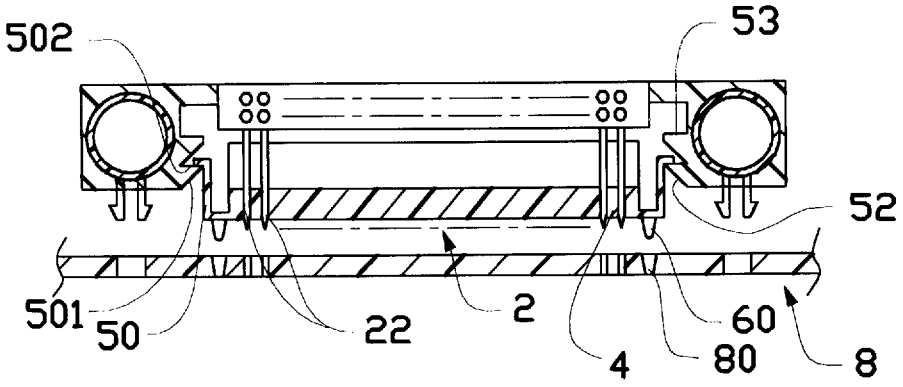
FIGS. 3(A)–3(B) are cross-sectional views along line III—III of FIG. 2 of the high density electrical connector in accordance with the present invention showing the gradual insertion of the contacts with regard to a circuit board.
Figure 3:
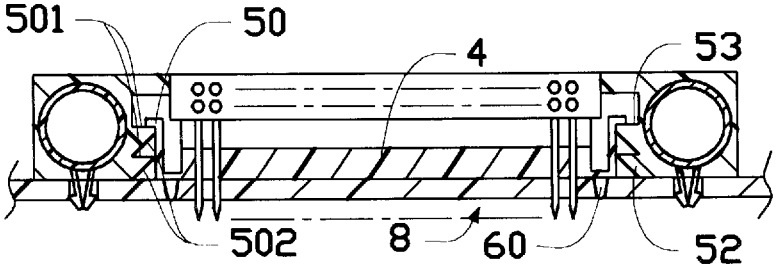

Secondly, as shown in FIG. 3 (B), when the connector located on the circuit board (8) is further depressed by a second manual operation, each latching portion (51) of the spacer (4) is inwardly compressed again by another guiding surface (501) of the second stage (53) to elastically enter another groove (50) located above the second stage (53) and to retentively engage with the engaging surface (502) of the second stage (53) whereby the spacer (4) can be permanently retained in the housing (1). Concurrently, the tail portions (22) of the contacts (2) are precisely inserted through both of the cavities of the spacer (4) and the apertures of the circuit board (8) with a longer length thereof. Therefore, by means of gradual cooperation between the two-stage locking means (7) of the housing (1) and the latching portions (51) of the spacer (4), the contacts can be gradually oriented and guided in two stages by the cavities of the spacer (4) to be precisely inserted into the corresponding apertures of the circuit board (8) without resulting in a buckling of the contacts. The result of said assembly is shown in FIG. 2.

Additionally, the locking means of the housing (1) can be exchanged with the latching portion (51) of the spacer (4) to be another embodiment of the present invention (not shown), but the function thereof is identical with that of the first embodiment.

While the present invention has been described with reference to specific embodiments, the description is illustrative of the invention and is not to be construed as limiting in any way. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. An electrical connector for electrically connecting an exterior mating connector and a circuit board, comprising:

an insulative housing receiving therein a plurality of contacts having at least a contact portion and a tail portion;

a spacer having at least a plurality of cavities therein for orienting and receiving said contacts;

at least a locking means having a first engaging surface and a second engaging surface and formed on either the housing or the spacer; and at least a latching portion formed on the other of the housing and the spacer being opposite to said locking means, and retentively and separately cooperating with the first engaging surface and second engaging surface of said locking means so that the tail portions of the contacts are gradually oriented and guided in more than one stages by the cavities of the spacer to be exactly inserted into a plurality of apertures formed on the circuit board wherein said first engaging surface and second engaging surface are arranged in a vertical alignment with each other.

2. The electrical connector as described in claim 1, wherein the locking means further includes a first stage and a second stage wherein said first engaging surface is formed on the first stage and said engaging surface is formed on the second stage.

3. The electrical connector as described in claim 2, wherein each stage further defines a groove for receiving said latching portion, and forms a guiding surface for guiding the latching portion to enter the groove.

4. The electrical connector as described in claim 1, wherein the spacer further forms a pair of posts for guiding the contacts to align with the apertures of the circuit board.

5. A high density electrical connector for electrically connecting an exterior mating connector and a circuit board, comprising:

an insulative housing receiving therein a plurality of contacts having at least a contact portion and a tail portion;

a spacer having at least a plurality of cavities therein for orienting and receiving the tail portions of said contacts;

at least a locking means having a first stage and a second stage and formed on either the housing or the spacer wherein the first stage and the second stage are respectively located at different levels and arranged in a vertical alignment with each other; and at least a latching portion formed on other of the housing and the spacer which has no said locking means thereon, and retentively and separately cooperating with the first stage and the second stage of said locking means;

whereby the tail portions of the contacts are oriented and guided in two stages by the cavities of the spacer to be precisely inserted into a plurality of apertures formed on the circuit board.

6. The electrical connector as described in claim 5, wherein the first stage and the second stage are arranged to be a tooth-like structure.

7. A method of assembly of an electrical connector with a circuit board, comprising the steps of:

assembling an insulative housing disposed with a plurality of contacts to a spacer having a plurality of cavities by means of cooperation between at least a latching portion and a locking means wherein the latching portion retentively engages a first stage formed on the locking means by a first manual operation thereby inserting the contacts through the corresponding cavities of the spacer in a tip portion thereof;

further assembling the electrical connector equipped with the spacer to the circuit board wherein the latching portion further retentively engages a second stage formed on the locking means by a second manual operation so that the contacts are precisely inserted through both of the cavities of the spacer and the apertures of the circuit board in a substantial length thereof wherein said first stage and second stage are arranged in a vertical alignment with each other.

* * * * *